US006831613B1

(12) United States Patent
Gothard et al.

(10) Patent No.: US 6,831,613 B1
(45) Date of Patent: Dec. 14, 2004

(54) MULTI-BAND RING FOCUS ANTENNA SYSTEM

(75) Inventors: Griffin K. Gothard, Satellite Beach, FL (US); Jay A. Kralovec, Melbourne, FL (US); Timothy E. Durham, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/600,627

(22) Filed: Jun. 20, 2003

(51) Int. Cl.[7] ..... H01Q 13/00
(52) U.S. Cl. ..... 343/779; 343/781 CA
(58) Field of Search ..... 343/779, 781 CA, 343/781 P, 837, 836

(56) References Cited

U.S. PATENT DOCUMENTS 5,907,309 A 5/1999 Anderson et al.
6,211,834 B1 4/2001 Durham et al.
6,323,819 B1 11/2001 Ergene
6,356,241 B1 * 3/2002 Jaeger et al. ..... 343/789
6,563,470 B2 * 5/2003 Em et al. ..... 343/756
6,603,437 B2 * 8/2003 Chang ..... 343/781 CA
6,642,900 B2 * 11/2003 Bhattacharyya et al. .... 343/786
6,720,932 B1 * 4/2004 Flynn et al. ..... 343/786

* cited by examiner

*Primary Examiner*—Don Wong
*Assistant Examiner*—Huedung X Cao
(74) *Attorney, Agent, or Firm*—Sacco & Associates, PA

(57) ABSTRACT

Method and apparatus for feeding a compact main reflector of an RF antenna on a plurality of spectrally offset frequency bands. The method can include the steps of forming a focal ring for a main reflector (304) by positioning an RF source (301) at a first frequency within a first frequency band in the far field relative to a shaped non-linear surface of revolution so that the shaped non-linear surface of revolution forms a subreflector (302). A second focal ring can be formed for the main reflector (304) by positioning a second RF source (300) in the nearfield of the shaped non-linear surface of revolution.

23 Claims, 4 Drawing Sheets

MULTI-BAND RING FOCUS ANTENNA SYSTEM

STATEMENT REGARDING FEDERALLY SPONSORED RESEARCH OR DEVELOPMENT

The United States Government has rights in this invention pursuant to Contract No. N00039-00D-3210 between the United States Navy and Harris Corporation.

BACKGROUND OF THE INVENTION

1. Statement of the Technical Field

The invention concerns antenna systems, and more particularly ring focus antennas configured for concurrent multi-band operation.

2. Description of the Related Art

It is desirable for microwave satellite communication antennas to have the ability to operate on multiple frequency bands. Upgrading existing equipment to such dual band capability without substantially changing antenna packaging constraints can be challenging. For example, there can be existing radomes that impose spatial limitations and constraints on the size of the reflector dish. The existing antenna location and packaging can also limit the dimensions of the antenna feed system. For example, the existing radome can limit the forward placement of the feedhorn and the subreflector. Similarly, modifications to the existing opening in the main reflector are preferably avoided. As a result, for small aperture reflectors, the feed horn and the subreflector must fit in a relatively small cylinder.

In view of these spatial limitations, special techniques must be used to maintain antenna efficiency. U.S. Pat. No. 6,211,834 B1 to Durham et al. (hereinafter Durham), concerns a multi-band shaped ring focus antenna. In Durham, a pair of interchangeable, diversely shaped close proximity-coupled sub-reflector-feed pairs are used for operation at respectively different spectral frequency bands. Swapping out the subreflector/feed pairs changes the operational band of the antenna. Advantage is gained by placement of the shaped subreflector in close proximity to the feed horn. This reduces the necessary diameter of the main shaped reflector relative to a conventional dual reflector antenna of the conventional Cassegrain or Gregorian variety. The foregoing arrangement of the feed horn in close proximity to the sub-reflector is referred to as a coupled configuration.

The coupled configuration described in Durham generally involves subreflector to feed horn spacing on the order of two wavelengths or less. This is in marked contrast to the more conventional sub-reflector to feed horn spacing used in a decoupled configuration that is typically on the order of several to tens of wavelengths.

Although Durham demonstrates how a ring focus antenna may operate at different spectral bands, sub-reflector-feed pairs must be swapped each time the operational band of the antenna is to be changed. Accordingly, that system does not offer concurrent operation on spectrally offset frequency bands.

U.S. Pat. No. 5,907,309 to Anderson et al. and U.S. Pat. No. 6,323,819 to Ergene each disclose dual band multimode coaxial antenna feeds that have an inner and outer coaxial waveguide sections. However, neither of these systems solve the problem associated with implementing dual band reflector antennas in very compact antenna packaging configurations.

SUMMARY OF THE INVENTION

A compact multi-band antenna system includes a main reflector having a shaped surface of revolution about a boresight axis of the antenna. The main reflector is operable at a plurality of frequency bands spectrally offset from each other. For example, the higher one of the frequency bands can be Ka-band and the lower one of the frequency bands can be X-band.

A multi-band feed system provided for the main reflector includes a shaped non-linear surface of revolution about the boresight axis of the antenna. A plurality of feed elements are also provided. A first one of the feed elements for a high frequency band is installed at a first feed element location separated by a first gap from a vertex of the shaped non-linear surface of revolution on the boresight axis of the antenna. For example, the first gap can be more than about four wavelengths at a frequency defined within the first one of the frequency bands from the vertex to the feed aperture.

The first feed element can be decoupled from the shaped non-linear surface of revolution and illuminates the shaped non-linear surface of revolution. The shaped non-linear surface of revolution functions as a subreflector for the first feed element. The subreflector defines a ring-shaped focal region about the boresight axis for illuminating the main reflector at a first one of the frequency bands.

A second one of the feed elements for a lower frequency band can be installed at a second feed element location separated from the vertex on the boresight axis by a second gap. For example the second gap can be less than about two wavelengths from the vertex of the shaped non-linear surface of revolution at a frequency defined within the second one of the frequency bands. Consequently, the second feed element is closely coupled to the shaped non-linear surface of revolution at a second one of the frequency bands.

The second feed element and the shaped non-linear surface of revolution can together form a single integrated coupled feed. The diameter of the focal ring of the main reflector at the lower frequency band is advantageously selected to be about the same size as the diameter of the shaped non-linear surface of revolution. Consequently, it is possible to use the single coupled feed to form a focal ring matched to the main reflector at the lower one of the frequency bands. In effect, the shaped non-linear surface of revolution in the single coupled feed performs as a splash plate. The single coupled feed also provides a transition from a circular to radial waveguide mode.

Notably, the single structure defining the shaped non-linear surface of revolution performs two very different functions at the two separate frequency bands. At the high band it functions as a sub-reflector whereas at the low band it functions as a splash plate defining part of the single coupled feed. In order to facilitate this result, the main reflector and the shaped non-linear surface of revolution can each have no continuous surface portion thereof shaped as a regular conical surface of revolution. Instead, these shapes can be numerically defined using computer modeling programs.

The invention can also include a method for operating a compact multi-band antenna system. The method can include the steps of providing a main reflector having a shaped surface of revolution about a boresight axis of the antenna, forming a ring-shaped focal region about the boresight axis, and using a subreflector in the far field relative to a first feed element aligned with the boresight axis. Further, a second feed element can be aligned with the boresight axis in a nearfield position coupled to the sub-reflector to form in combination with the sub-reflector a single feed that transforms a circular waveguide mode into a radial waveguide mode for illuminating the main reflector. The first feed element can be selected to operate at a relatively higher band as compared to the second feed element. For example, the first feed element can operate within Ka-band and the second feed element can operate within X-band.

According to another aspect of the invention, the method can include positioning an aperture of the first feed element spaced more than about four wavelengths from a vertex of the shaped non-linear surface of revolution at a frequency within the first spectrally offset frequency band, and positioning an aperture of the second feed element spaced less than about two wavelengths from a vertex of the shaped non-linear surface of revolution at a frequency within the second spectrally offset frequency band. A focal ring of the main reflector can be advantageously selected to be about the same size as the shaped non-linear surface of revolution. The method can also include selecting the main reflector and the subreflector to have no continuous surface portion thereof shaped as a regular conical surface of revolution.

According to another aspect, the invention can include a method for feeding a compact main reflector of an RF antenna on a plurality of spectrally offset frequency bands. The method can include the steps of forming a focal ring for a main reflector by positioning an RF source at a first frequency within a first frequency band in the far field relative to a shaped non-linear surface of revolution so that the shaped non-linear surface of revolution operates as a subreflector. A second focal ring can be formed for the main reflector by positioning a second RF source in the nearfield of the shaped non-linear surface of revolution. The second RF source can interact with the shaped non-linear surface of revolution to form a single feed network at the second RF frequency. The single feed network can form a coupled feed focal ring for the main antenna where the single feed network transforms a circular waveguide mode of said second RF source to a radial waveguide mode.

DETAILED DESCRIPTION OF THE INVENTION

Figure 1:
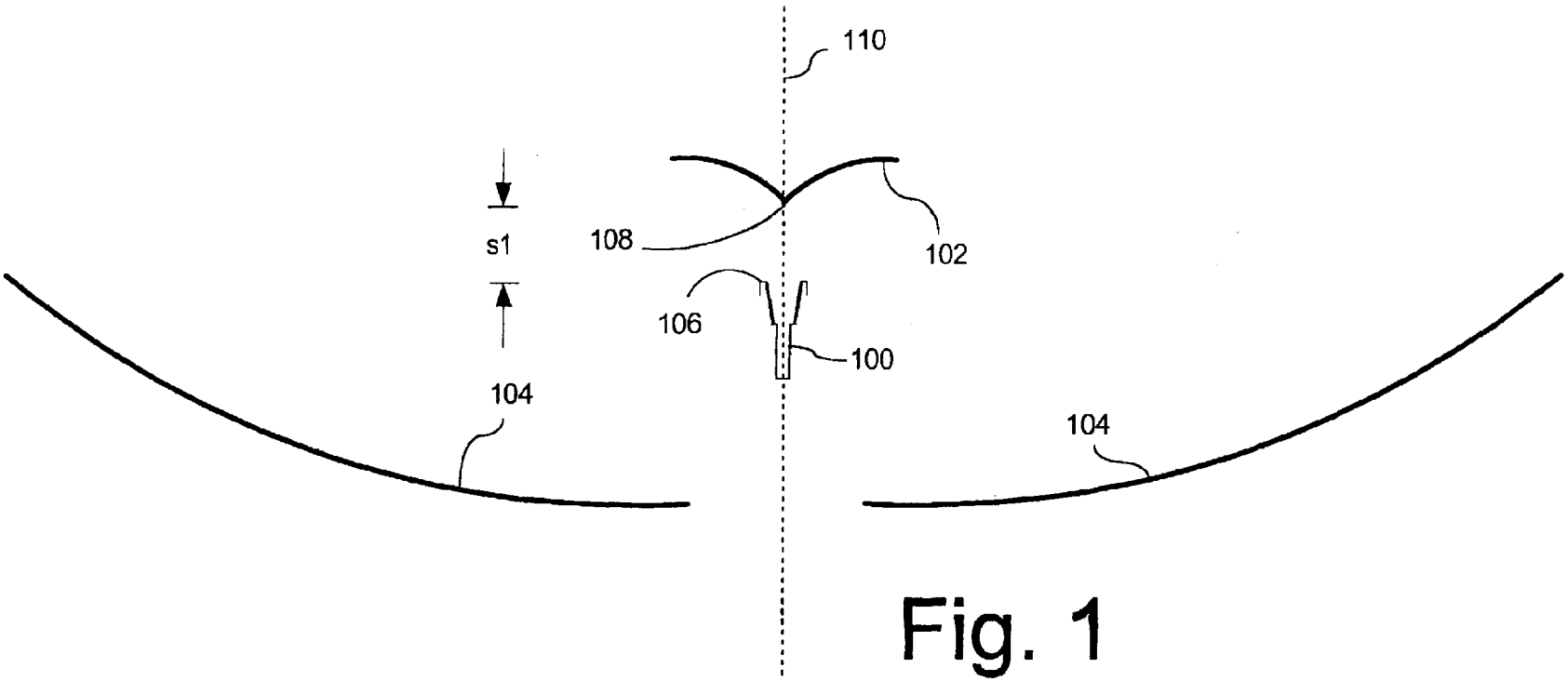
Fig. 1 (Prior Art)
FIG. 1 is a schematic representation of a decoupled ring-focus reflector antenna design that is useful for understanding the invention.

Ring focus antenna architectures commonly make use of a dual reflector system as shown in FIG. 1. With the dual reflector system, an RF feed 100 illuminates a sub-reflector 102, which in turn illuminates the main reflector 104. Sub-reflector 102 and main reflector 104 are shaped surfaces of revolution about a boresight axis 110 and are suitable for reflecting RF energy. Typical Cassegrain and Gregorian type reflector systems commonly use feed horns and sub-reflectors arranged in accordance with a decoupled configuration. These are sometimes referred to as decoupled feed/subreflector antennas.

In a decoupled feed/subreflector antenna, the RF feed 100 is located in the far field of the sub-reflector 102. For example, the aperture 106 of the RF feed 100 can be positioned spaced from a vertex 108 of the sub-reflector 102 by a distance at the frequency of interest, where s1 is greater than or equal to about four wavelengths. Since the RF feed is in the far-field, the decoupled feed/subreflector configuration lends itself to optical design techniques such as ray tracing, geometrical theory of diffraction (GTD) and so on.

Figure 2:
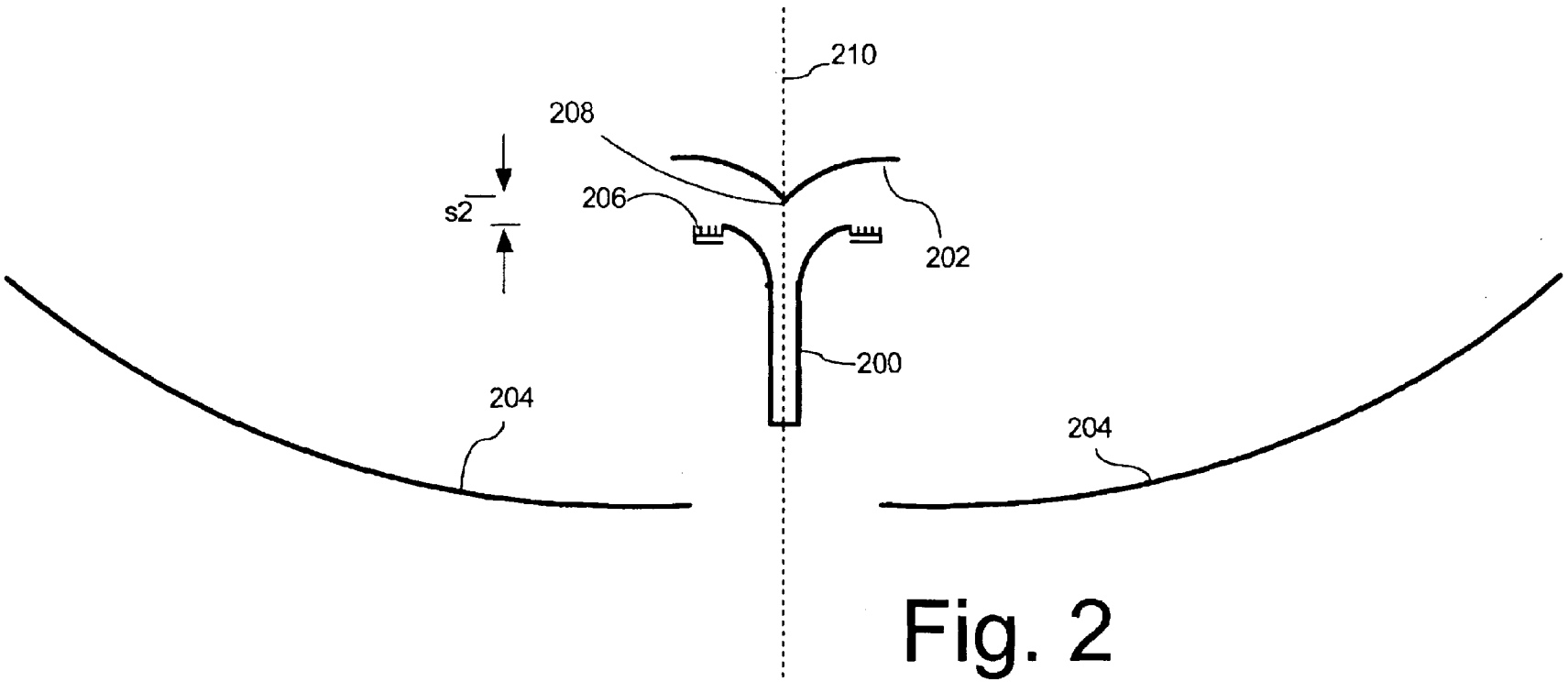
Fig. 2 (Prior Art)
FIG. 2 is a schematic representation of a coupled-feed ring-focus reflector antenna design that is useful for understanding the invention.

A second known type of ring focus antenna system illustrated in FIG. 2 is known as a coupled-feed/sub-reflector antenna. Similar to the antenna in FIG. 1, this type of antenna makes use of a sub-reflector 202 and main reflector 204 that are shaped surfaces of revolution about a boresight axis 210 and are suitable for reflecting RF energy. In this type of antenna, the RF feed 200 and the subreflector 202 are spaced more closely as compared to the decoupled configuration. An aperture 206 of the RF feed and the vertex 208 of the sub-reflector 202 can be spaced apart by a distance s2 that is typically less than about 2 wavelengths at the frequency of interest. When arranged in this way, the RF feed 200 and the subreflector 202 are said to be coupled in the near-field to generate what is commonly known as a "back-fire" feed.

In a back-fire feed configuration, the RF feed 200 and the sub-reflector 202 in combination can be considered as forming a single integrated feed network. This single feed network is particularly noteworthy as it provides a circular to radial waveguide transition that generates a prime-ring-focus type feed for the main reflector 204. In this regard, the back-fire feed can be thought of as being similar to a prime-focus parabolic feed. Further, the sub-reflector 202 in this feed configuration is not truly operating as a reflector in the conventional sense but rather as a splash-plate directly interacting with the feed aperture 206.

The ring focus antenna in FIG. 2 can employ a shaped-geometry main reflector and a shaped-geometry sub-reflector feed similar to the arrangement described in U.S. Pat. No. 6,211,834 B1 to Durham et al., the disclosure of which is incorporated herein by reference. In Durham et al., interchangeable, diversely shaped close proximity-coupled sub-reflector/feed pairs are used with a single multi-band main reflector for operation at respectively different spectral frequency bands. Swapping out the sub-reflector/feed pairs changes the operational band of the antenna.

Each of the main reflector and the sub-reflector in the system described in Durham et al. are respectively shaped as a distorted or non-regular paraboloid and a distorted or non-regular ellipsoid.

Figure 3:
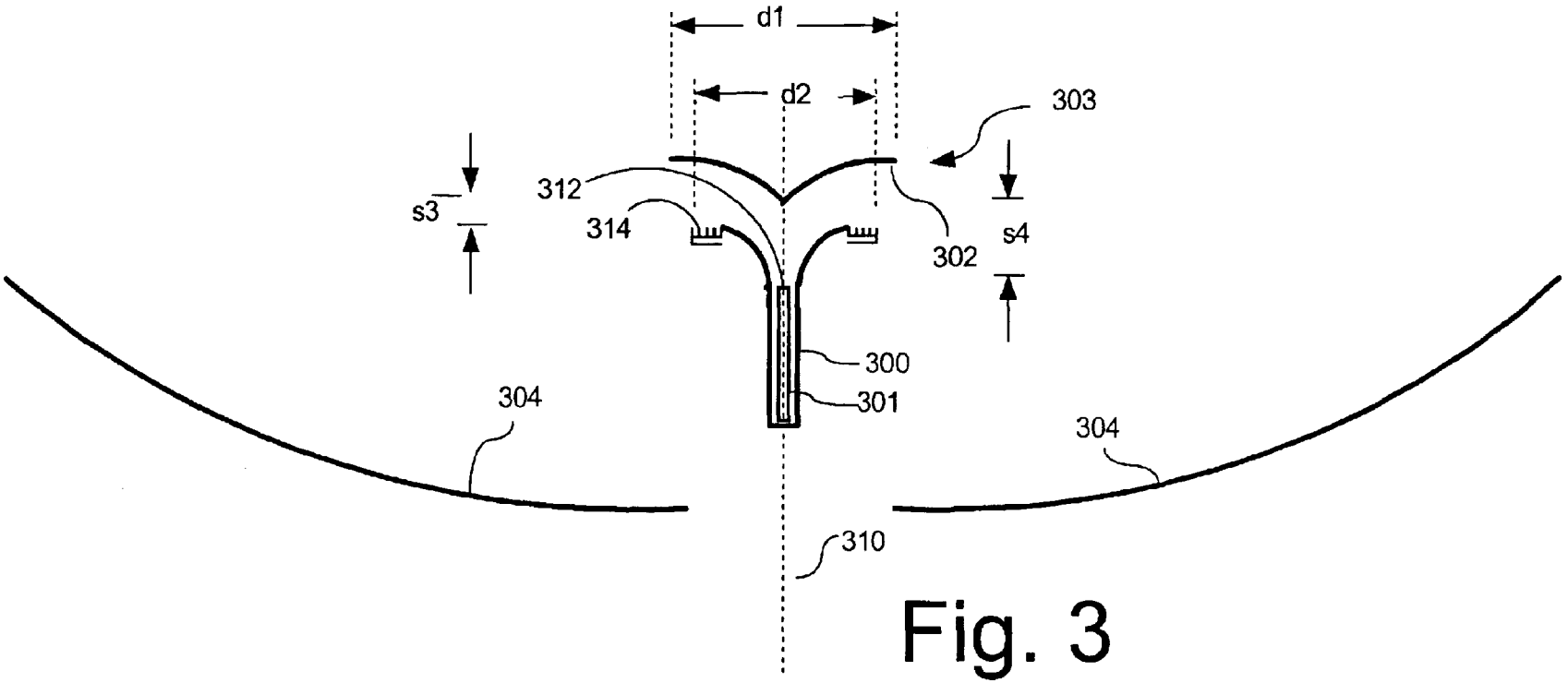
FIG. 3 is a schematic representation of a hybrid antenna system that combines the features of the antennas in FIGS. 1 and 2.

The present invention combines the concept of the decoupled feed/subreflector antenna in FIG. 1 and coupled feed/subreflector antenna in FIG. 2 to provide multi-band capability in a very compact design. As shown in FIG. 3, a single main reflector 304 and a single sub-reflector 302 can be used concurrently with a set of RF feeds 300, 301 for two spectrally offset RF frequency bands. In particular these can include a lower frequency band serviced by RF feed 300 and a higher frequency band serviced by RF feed 301. The RF feeds 300, 301 and the subreflector 302 together comprise a hybrid feed 303 that is specifically designed to be concurrently used with shaped main reflector 304. The main reflector 304 and the sub-reflector 302 are each shaped non-linear surfaces of revolution. In general, the shape of the main reflector and the sub-reflector are not definable by an equation as would normally be possible in the case of a regular conic, such as a parabola or an ellipse. Instead, the shapes are generated by executing a computer program that solves a prescribed set of equations for certain pre-defined constraints.

The RF feeds 300, 301 can be advantageously coaxially located along a boresight axis 310 of the antenna as shown. Each is separated from the vertex 308 by a respective gap s3 and s4. The RF feed 301 is preferably in a location along the boresight axis 310 that it is in the far-field of the subreflector 302 and therefore decoupled with respect thereto. RF feed 300 is in a location along the boresight axis that it is in the near field of the sub-reflector 302 and is therefore said to be coupled to the sub-reflector. For example, the gap s4 for RF feed 301 can be more than about four wavelengths at a frequency defined at the low end of the high frequency one of the frequency bands from the vertex 308 to the feed aperture 312. By comparison, the gap s3 between the vertex 308 and the aperture 314 for the RF feed 300 can be less than about 2 wavelengths and preferably about one wavelength at a frequency defined within the lower one of the frequency bands.

Using techniques similar to those disclosed in Durham et al., the subreflector 302 and the main reflector 304 can be advantageously shaped using computer modeling and a set of predefined constraints to allow the coaxially located RF feeds 300, 301 to concurrently function with the single sub-reflector 302 and single main reflector 304. Advantageously, this can be accomplished with the two RF feeds 300, 301 located at different relative distances from the vertex 308 and operating on different frequency bands. For example, the higher frequency one of the frequency bands can be Ka-band and the lower one of the frequency bands can be X-band.

The subreflector 302 advantageously defines a ring-shaped focal point about the boresight axis for illuminating the main reflector with RF generated by RF feed 301 at the higher one of the frequency bands. The feed element 300 and the shaped non-linear surface of revolution defined by the sub-reflector 302 can together form a single integrated coupled feed that also provides a transition from a circular to radial waveguide mode.

According to a preferred embodiment, the diameter of the focal ring of the main reflector at the second frequency and the diameter d of the shaped non-linear surface of revolution defining the sub-reflector 302 are advantageously selected to be about the same size. If they are not, the coupled feed focal ring will not be coincident with the single main focal ring defined by the main antenna. Further, the diameter d1 of the subreflector 302 is preferably not much larger than the diameter d2 of RF feed 300. Using these guidelines, it is possible to use the single coupled feed comprised of sub-reflector 302 and RF feed 300 to form a focal ring suitably matched to the main reflector at the frequency band of the feed 300.

Notably, the single subreflector 302 defined by the shaped non-linear surface of revolution performs two very different functions at the two separate frequency bands. At the high band (RF feed 301) it truly functions as a subreflector whereas at the low band (RF feed 300) it functions more as a splash plate defining part of the single coupled feed.

In order to facilitate the use of sub-reflector 302 and main reflector 304 concurrently on the two separate frequency bands, they must each be shaped so as to have no continuous surface portion thereof shaped as a regular conical surface of revolution. According to a preferred embodiment, the precise shape of the main reflector 304 and the sub-reflector 302 can be determined based upon computer analysis.

According to a preferred embodiment, a computer program can be used to determine suitable shapes for the sub-reflector 302 and the main reflector 304. This process generates a numerically defined dual reflector system as shown and described relative to FIG. 3. The resulting shape of the main reflector is a conical surface of revolution that is generally, but not necessarily precisely, parabolic. The resulting shape of the sub-reflector is likewise a conical surface of revolution that is generally, but not necessarily precisely, elliptical.

Given the prescribed positions of RF feeds 300, 301 and boundary conditions for the antenna, the shape of the sub-reflector 302 and the main reflector 304 are generated by executing a computer program that solves a prescribed set of equations for the predefined constraints. Physical constraints drive some of the boundary conditions, such as the size of the subreflector 302 and the size of the main reflector 304. Electromagnetic constraints drive other boundary conditions. For example, if the electrical spacing of the phase center for RF feed 301 to subreflector 302 is less than about four wavelengths at the high frequency band, then the operation of the subreflector will no longer behave optically and the system will not perform properly. Similarly, if the feed phase center is too far from the subreflector 302, then the low band feed will block the line-of-site between the phase center of RF feed 301 and subreflector 302 and the high band system will not perform properly. Further, the throat 330 of the feed 300 must be at or behind the aperture 312 of RF feed 301.

Given the foregoing constraints, equations are employed which: 1—achieve conservation of energy across the antenna aperture, 2—provide equal phase across the antenna aperture, and 3—obey Snell's law. Details regarding this process are disclosed in U.S. Pat. No. 6,211,834 to Durham et al.

For a given generated configuration of RF feed 300 and a given set of shapes for the sub-reflector 302 and the main reflector 304, the performance of the antenna is analyzed by way of computer simulation. This analysis determines whether the generated antenna shapes will produce desired directivity and sidelobe characteristics for the low frequency band associated with feed 300. RF matching components are used to achieve the desired return loss.

If the design performance criteria are not initially satisfied for the lower frequency band, one or more of the equations' parameter constraints are iteratively adjusted, and the performance of the antenna is analyzed for the new set of shapes. This process is iteratively repeated, as necessary until the shaped antenna sub-reflector shape and coupling configuration, and main reflector shape, meets the antenna's intended operational performance specification.

This iterative shaping and performance analysis sequence is also conducted for another (spectrally separate) band, such as Ka-band to realize a set of sub-reflector and main reflector shapes at the higher frequency operational band. The higher band of operation associated with RF feed 301 is advantageously configured with a sub-reflector/feed element configuration that is decoupled as show in FIG. 3.

Each of the feed configurations, and the shapes for the subreflector and main reflector may be derived separately, as described above. According to a preferred embodiment, however, it is possible to first derive a first set of shapes for main reflector 304 and sub-reflector 302 for the lower frequency band based on a first feed configuration. These shapes can then be used to derive the feed configuration for the higher frequency band that is necessary to achieve the required antenna performance. The foregoing approach can achieve good efficiencies and sidelobe performance results on both of the bands.

Figure 4:
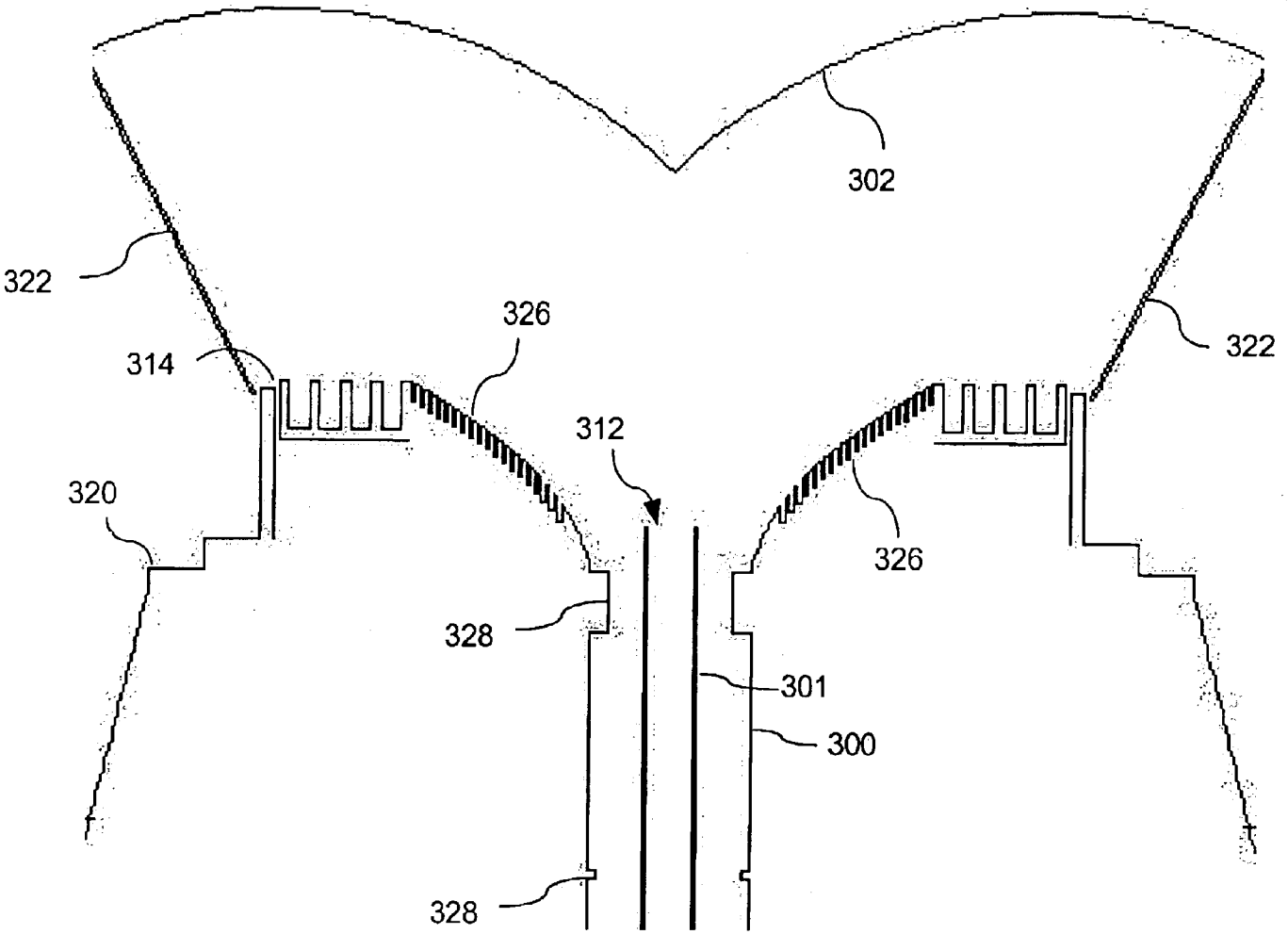
FIG. 4 is an enlarged view of the feed system in FIG. 3.

FIG. 4 is an enlarged view of the hybrid feed 303 which shows RF feeds 300, 301 in more detail. RF matching features 326 can be provided for the RF feed 301 on a flared portion of RF feed 300. RF matching features 328 for RF feed 300 can also be formed on a throat portion of the RF feed 300. Subreflector supports 322 can be provided along an outer perimeter of the feed system to minimize interference with the operation of the feed. The subreflector supports 322 are preferably formed of a dielectric material to minimize interaction with the operation of the feed. FIG. 4 also shows details of an RF packaging can 320.

Finally, it should be noted that while the antennas described herein have for convenience been largely described relative to a transmitting mode of operation, the invention is not intended to be so limited. Those skilled in the art will readily appreciate that the antennas can be used for receiving as well as transmitting.

We claim:

1. A compact multi-band antenna system comprising:

a main reflector having a shaped surface of revolution about a boresight axis of said antenna and being operable at a plurality of frequency bands spectrally offset from each other;

a multi band feed system for said main reflector comprising a shaped non-linear surface of revolution about said boresight axis of said antenna and a plurality of feed elements;

a first one of said feed elements installed at a first feed element location separated by a first gap from a vertex of said shaped non-linear surface of revolution on said boresight axis of said antenna, said first feed element illuminating said shaped non-linear surface of revolution which defines a ring-shaped focal point about said boresight axis for illuminating said main reflector at a first one of said frequency bands; and a second one of said feed element installed at a second feed element location separated from said vertex on said boresight axis by a second gap, said second feed element coupled to said shaped non-linear surface of revolution at a second one of said frequency bands to form a single coupled feed, said single coupled feed defining a focal ring for illuminating said main reflector at said second one of said frequency bands.

2. The compact multi-band antenna system according to claim 1 wherein said first feed element is decoupled from said shaped non-linear surface of revolution.

3. The compact multi-band antenna system according to claim 1 wherein said first feed element is further comprised of a feed aperture and said first gap is more than about four wavelengths at a frequency defined within said first one of said frequency bands from said vertex to said feed aperture.

4. The compact multi-band antenna system according to claim 1 wherein said second gap is less than about two wavelengths from said vertex at a frequency defined within said second one of said frequency bands.

5. The compact multi-band antenna system according to claim 1 wherein said main reflector and said shaped non-linear surface of revolution each have no continuous surface portion thereof shaped as a regular conical surface of revolution.

6. The compact multi-band antenna system according to claim 1 wherein said first one of said frequency bands is Ka-band and said second one of said frequency bands is X-band.

7. The compact multi-band antenna system according to claim 1 wherein said shaped non-linear surface of revolution is shaped to form a sub-reflector for said first feed element.

8. The compact multi-band antenna system according to claim 1 wherein said shaped non-linear surface of revolution in said single coupled feed is shaped to perform as a splash plate.

9. The compact multi-band antenna system according to claim 1 wherein a focal ring of said main reflector is about the same diameter as said shaped non-linear surface of revolution.

10. The compact multi-band antenna system according to claim 9 wherein a diameter of said shaped nonlinear surface of revolution has a diameter which is no more than about 150% the diameter of said second feed element.

11. The compact multi-band antenna system according to claim 1 wherein said single coupled feed forms a transition from a circular to radial waveguide.

12. A method for operating a compact multi-band antenna system comprising the steps of:

providing a main reflector having a shaped surface of revolution about a boresight axis of said antenna;

forming a ring-shaped focal point about said boresight axis using a subreflector in the far field relative to a first feed element aligned with said boresight axis; and positioning a second feed element aligned with said boresight axis in a nearfield position coupled to said sub-reflector to form in combination with said sub-reflector a single coupled feed, said single coupled feed defining a focal ring that transforms a circular waveguide mode into a radial waveguide mode for illuminating said main reflector.

13. The method according to claim 12 further comprising the step of forming said sub-reflector as a shaped non-linear surface of revolution about said boresight axis.

14. The method according to claim 12 further comprising the step of selecting said first feed element to operate within Ka-band and said second feed element to operate within X-band.

15. The method according to claim 12 further comprising the step of selecting said first feed element to have an operating frequency spectrally offset from said second feed element.

16. The method according to claim 12 further comprising the step of concurrently operating said compact multi-band antenna on first and second spectrally offset frequency bands.

17. The method according to claim 16 further comprising the step of positioning an aperture of said first feed element spaced more than about four wavelengths from a vertex of said shaped non-linear surface of revolution at a frequency within said first spectrally offset frequency band.

18. The method according to claim 16 further comprising the step of positioning an aperture of said second feed element spaced less than about two wavelengths from a vertex of said shaped non-linear surface of revolution at a frequency within said second spectrally offset frequency band.

19. The method according to claim 12 further comprising the step of selecting said main reflector and said subreflector to each have no continuous surface portion thereof shaped as a regular conical surface of revolution.

20. The method according to claim 13 further comprising the step of selecting a focal ring of said main reflector to be about the same size as said shaped non-linear surface of revolution.

21. A method for feeding a compact main reflector of an RF antenna on a plurality of spectrally offset frequency bands comprising the steps of:

forming a focal ring for a main reflector by positioning an RF source at a first frequency within said first frequency band positioned in the far field relative to a shaped non-linear surface of revolution so that said shaped non-linear surface of revolution operates as a subreflector;

forming a second focal ring for said main reflector by positioning a second RF source in the nearfield of said shaped non-linear surface of revolution, said second RF source interacting with said shaped non-linear surface of revolution to form a single feed network at said second RF frequency, said single feed network forming a coupled feed focal ring for said main antenna.

22. The method according to claim 21 further comprising the step of transforming with said single feed network a circular waveguide mode of said second RF source to a radial waveguide mode.

23. The method according to claim 21 further comprising the step of positioning said first RF source coaxial with said second RF source.

* * * * *